US005626555A

United States Patent [19]

Di Blasi et al.

[11] Patent Number: 5,626,555

[45] Date of Patent: May 6, 1997

[54] SUPPORT STRUCTURE CONSISTING OF A PLURALITY OF MOBILE ELEMENTS FOR CHAIRS, BEDS AND THE LIKE

[75] Inventors: Carmelo Di Blasi; Carlo M. Di Blasi, both of Francofonte, Italy

[73] Assignee: Di Blasi Industriale S.r.l., Vizzini, Italy

[21] Appl. No.: 312,582

[22] Filed: Sep. 27, 1994

[30] Foreign Application Priority Data

Sep. 28, 1993 [IT] Italy ..... FI93A0185

[51] Int. Cl.[6] ..... A61G 7/015

[52] U.S. Cl. ..... 601/98; 5/612; 5/933; 5/934

[58] Field of Search ..... 601/51, 53, 54, 601/98, 90, 91, 92; 5/612, 915, 933, 934

[56] References Cited

U.S. PATENT DOCUMENTS

| | | | |
|---|---|---|---|
| 2,112,367 | 3/1938 | Hyter | 601/98 |
| 2,906,259 | 9/1959 | Adair | 601/92 |
| 3,298,363 | 1/1967 | Parkin | 5/934 |
| 4,136,409 | 1/1979 | Ishida | 5/934 |
| 4,999,861 | 3/1991 | Huang | 601/51 |
| 5,109,558 | 5/1992 | Di Blasi | 601/98 |

FOREIGN PATENT DOCUMENTS

| | | |
|---|---|---|
| 0374742 | 6/1990 | European Pat. Off. . |
| 845544 | 8/1939 | France . |
| 1346520 | 11/1963 | France . |

*Primary Examiner*—Robert A. Hafer
*Assistant Examiner*—Benjamin Koo
*Attorney, Agent, or Firm*—Kenyon & Kenyon

[57] ABSTRACT

Support structure consisting of a plurality of elements for chairs, beds and the like, which may be moved individually or in groups, in which the mechanism which performs the movement of the generic element downwards and successively upwards is composed by an articulated parallelogram having one side integral with said element, that side presenting a small wheel which is in rolling contact with a cam fitted to a shaft supported by a lug integral with the frame.

7 Claims, 2 Drawing Sheets

SUPPORT STRUCTURE CONSISTING OF A PLURALITY OF MOBILE ELEMENTS FOR CHAIRS, BEDS AND THE LIKE

THE FIELD OF THE INVENTION

The present invention relates to a support structure consisting of a plurality of transversal mobile elements for chairs, beds and the like. The elements in the support structure move vertically downwards and successively return upwards to their initial position by means of a cam mechanism.

STATE OF THE ART

It is common knowledge that persons who are obliged to sit or lie down for long periods of time (handicapped people, truck drivers etc.) suffer from disturbances caused by soreness in the parts of the body which remain in contact for long periods of time with the support structure which, in the case of a chair for example, consists of the back rest and the seat; this prolonged contact, combined with the difficulty of carrying out movements and with insufficient local blood circulation often leads to the formation of sores.

In the Art, other support structures exist for beds, chairs and the like shaped as transversal mobile elements.

There is for example a support structure for beds or chairs consisting of a plurality of transversal elements which can be lowered from the resting plane there being two groups each of which comprises half of these elements, each group being activated by a complex hydraulic mechanism. The fact that in this support structure the elements are not independent from each other but can only be lowered in groups which comprise first one half of the elements and then the other half of the elements, causes a periodical doubling of the pressure on the parts of the body which periodically come in contact with the elements left in the normal position. This can be counterproductive from the therapeutic point of view. Moreover, the elements move away from the plane of support in a circular trajectory. This means that the upper part of the mobile elements tends to "drag" across the patient's body. This "dragging" causes the person discomfort. In another embodiment there is a bed which facilitates the manipulation of a patient lying down for the treatment of malformations of the backbone. In accordance with the pre-established aims, the transversal mobile elements must conform to the patient's physical features. That is, they must exert sufficient pressure on each part of the patient's back in order to "manipulate" the backbone according to the therapy envisaged by the operator. In order to achieve this, the transversal mobile elements are raised in relation to the normal resting plane.

A cam mechanism is used for raising the elements.

SUMMARY OF THE INVENTION

In the support structure, object of the present invention, the mobile elements serve to cancel out the pressure exerted on the corresponding parts of the body in order to stimulate circulation and avoid the formation of sores.

The support structure which is the object of the present invention consists of a plurality of mobile elements and it is a structure wherein the mechanism which serves to move the generic element downwards and successively upwards consists of an articulated parallelogram which has one side integral with said element, that side presenting a small wheel in rolling contact with a cam fitted to a shaft supported by a lug integral with the frame.

The alternation of movements causes the periodical detachment of each element from the body area, making it possible to periodically cancel out the pressure on the body area above it, allowing for improved blood circulation and avoiding soreness.

LIST OF FIGURES

DETAILED DESCRIPTION OF THE INVENTION

With reference to FIGS. 1 to 4, a chair seat is generically indicated with 10 and comprises a frame 20 and a series of transversal elements 30, the upper surface of which constitutes the support plane 50 for the body. Said transversal elements 30 are adjacent, independent of one another and downwardly mobile in such a way as to shift away from their starting position where they are in contact with the body and to return to this position after a predetermined while.

Figure 1:
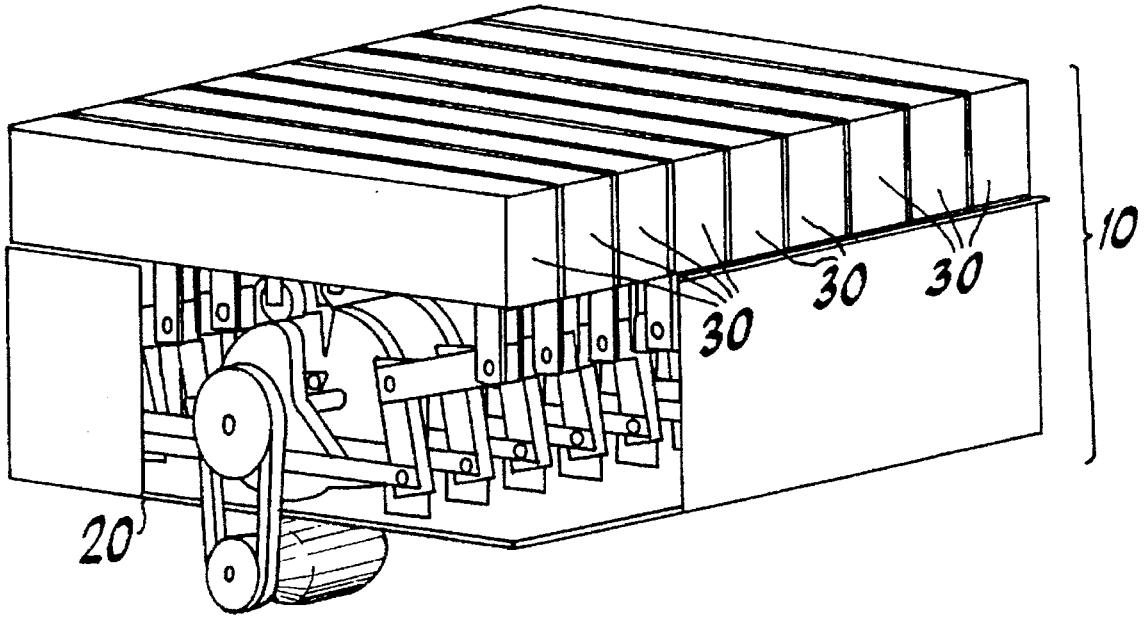
FIG. 1 shows a perspective view of the seat of a chair comprising a support structure in accordance with the present invention, with part of the drawing in cross-section for reason of clarity.
Figure 2:
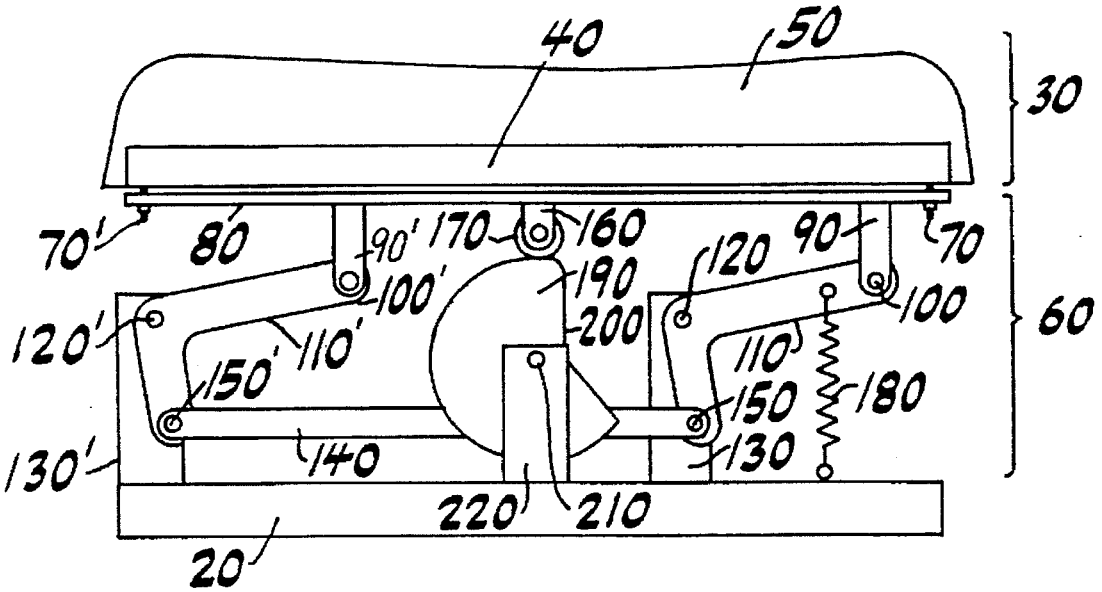
FIG. 2 illustrates a cross-section of the seat illustrated in FIG. 1, in which some parts have been omitted.

With reference to FIG. 2, each transversal element 30 is made up of a rigid base 40, preferably U-shaped, which supports a padded body 50 which could best be realized in foam rubber or some similar material.

The vertical movement first downwards and successively upwards of each element 30 is achieved by means of the deformation of an articulated parallelogram 60. In particular, the base 40 is bound by means of two screws, or by similar fixing devices 70 and 70', to the supporting bar 80 which constitutes the upper side of the articulated parallelogram 60.

This supporting bar 80 presents lugs 90 and 90' to which the two sides 110 and 110' of the parallelogram 60 are hinged at 100 and 100', sides 110 and 110' being more or less at right angles. These sides 110 and 110' are hinged at 120 and 120' to lugs 130 and 130' which protrude from the frame 20, while the bottom side 140 of the parallelogram 60 is hinged at 150 and 150' to the two sides 110 and 110'. A small wheel 170 is attached to a third lug 160 on the support bar 80 and this, as a result of gravity and the action of the spring 180, is forced to rest on the cam 190, presenting a depression 200 (active part of the cam), said cam 190 being fitted to the shaft 210, which is supported by a lug 220 protruding from the frame 20.

Figure 3:
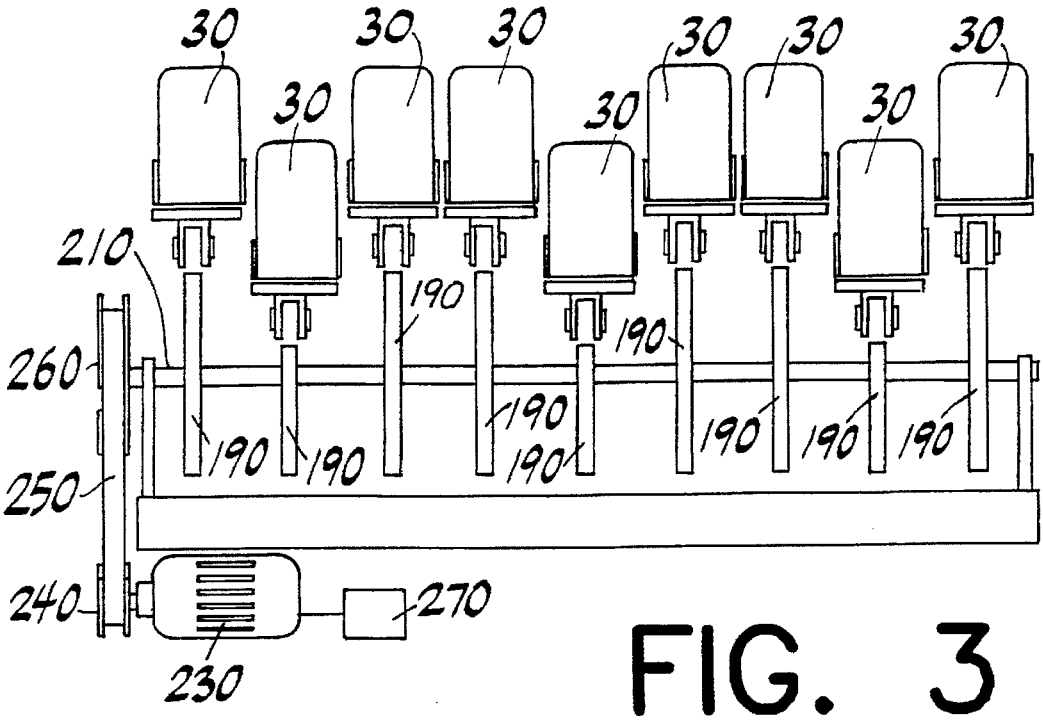
FIG. 3 illustrates the device which generates the movement of the individual elements which make up the support structure which is the object of the present invention.

In brief: the articulated parallelogram 60 for moving the generic element 30 is composed of side (support bar) 80, sides 110, 110' and side 140. With reference to FIG. 3, the motor reducer 230 by means of the primary toothed pulley 240, of the toothed belt 250 and of the secondary toothed pulley 260, rotates the shaft 210 to which cams 190 suitably moulded are fitted so that the transversal elements 30, as a result of the action of said cams 190 upon which they rest, move vertically downwards and successively upwards to return to their original position, one after the other of one group after the other according to a sequence which is achieved by suitably offsetting the cams from one another, or else by making the cams 190 either integral with of idle from the shaft 210.

As can be seen from FIGS. 2 and 3, when the small wheel 170, consisting for example of a ball bearing, arrives at the depression 200 (active phase of the cam) the element 30 is lowered, as a result of its own weight and of the spring 180 which acts on side 110 which pivots on 120.

It is also possible to activate fixing elements (such as keys, tongues, etc.) by electronic means in order to make the cams 190 integral with the shaft 210 in a programmed manner and thus obtain the desired sequence of the elements 30.

For example, if the cams 190 are progressively offset at 180', the elements go up and down in alternation. If on the other hand, the cams 190 are offset at 120', the elements 30 go up and down in a ratio of one to two, which is the situation in FIG. 3 which illustrates the preferred solution from the medical point of view. By suitably moulding and offsetting the cams 190, other combinations are also possible.

The elements 30 remain in the lowered position for a predetermined interval of time and this is achieved by means of a timer 270 which controls the motor reducer 230.

Figure 4:
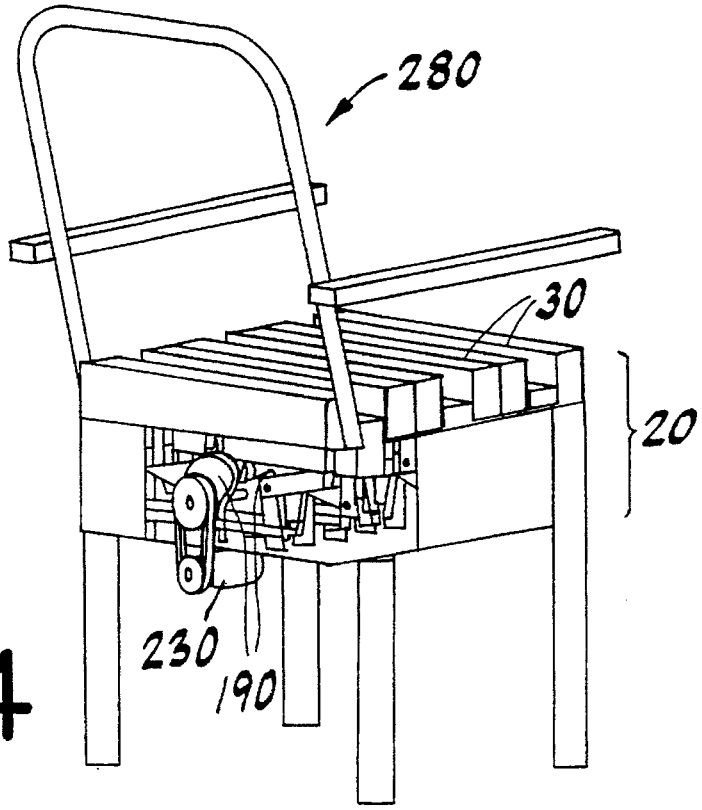
FIG. 4 illustrates a view in perspective of a chair that has a seat with the support structure which is the object of the present invention.

FIG. 4 illustrates a perspective view of a chair 280 having a seat 10 in accordance with the present invention, where the elements 30 are moved alternately by the cams 190 activated by the motor reducer 230 situated at the back of the seat.

Although in the preceding description for simplicity's sake mention has only been made of a chair seat, it is possible without diverging from the scope of the present invention to apply the support structure which is the object of the present invention to either the back rest of a chair or to a bed or the like.

We claim:

1. A support structure for chairs, beds and the like, comprising:

a plurality of support elements movable individually or in groups between a support position and a lower position, wherein at any given time at least some of said support elements are in said support position and said support elements in said support position at any given time generally define a body support surface for supporting a person's body; and a plurality of mechanisms each associated with one of said support elements for lowering support elements from and successively returning said support elements to said support position to temporarily relieve body supporting pressure on a portion of the body, each mechanism including an articulated parallelogram structure including the respective support element, said parallelogram structure hingedly connected to a frame, each mechanism also including a follower connected to said support element and a cam engaging said follower, said cam comprising a disk mounted on-center on a shaft supported by said frame and including a circular portion and a depression, said support elements being lowered from and successively returned to said support position when respective followers travel along the depressions of said cams during rotation of said cams, said support elements remaining at said support position when respective followers travel along said circular portion of said cams during rotation of said cams.

2. The support structure of claim 1, wherein one side of each parallelogram structure is stressed by at least one spring.

3. The support structure of claim 1, wherein each cam is offset relative to preceding and subsequent cams such that said elements are lowered from and successively returned to said support position one after another or one group after another according to a predetermined sequence.

4. The support structure of claim 3, wherein said sequence is preset using electronic control means.

5. The support structure of claim 1, wherein said support structure is useable in a back rest of a chair.

6. The support structure of claim 1, wherein said support structure is useable in a seat of a chair.

7. The support structure of claim 1, wherein said support structure is useable in a bed.

* * * * *